US007641744B2

(12) United States Patent
Winkelmann

(10) Patent No.: US 7,641,744 B2
(45) Date of Patent: Jan. 5, 2010

(54) SUPERFINISHING OF HIGH DENSITY CARBIDES

(75) Inventor: Lane W. Winkelmann, New Ulm, TX (US)

(73) Assignee: REM Technologies, Inc., Southington, CT (US)

( * ) Notice: Subject to any disclaimer, the term of this patent is extended or adjusted under 35 U.S.C. 154(b) by 341 days.

(21) Appl. No.: 11/400,835

(22) Filed: Apr. 6, 2006

(65) Prior Publication Data

US 2008/0196793 A1 Aug. 21, 2008

Related U.S. Application Data

(60) Provisional application No. 60/668,901, filed on Apr. 6, 2005.

(51) Int. Cl.
*B24C 1/00* (2006.01)
*C23F 1/28* (2006.01)

(52) U.S. Cl. ..... 148/274; 216/52; 216/53; 216/87; 451/32; 148/240; 148/243

(58) Field of Classification Search ..... 148/274; 216/52–53, 87; 451/32
See application file for complete search history.

(56) References Cited

U.S. PATENT DOCUMENTS

| | | | | |
|---|---|---|---|---|
| 4,491,500 | A | 1/1985 | Michaud et al. | 156/628 |
| 4,705,594 | A | 11/1987 | Zobbi et al. | 216/90 |
| 4,818,333 | A | 4/1989 | Michaud | 156/628 |
| 4,906,327 | A | 3/1990 | Michaud et al. | 216/90 |
| 4,921,025 | A | 5/1990 | Tipton et al. | 148/233 |
| 4,927,472 | A | 5/1990 | Matsushima et al. | 148/261 |
| 5,047,095 | A * | 9/1991 | Geke et al. | 148/259 |
| 5,051,141 | A | 9/1991 | Michaud et al. | 148/269 |
| 5,158,623 | A | 10/1992 | Michaud et al. | |
| 5,158,629 | A | 10/1992 | Zobbi | 216/53 |
| RE34,272 | E | 6/1993 | Michaud et al. | |
| 5,503,481 | A | 4/1996 | Hashimoto et al. | 384/569 |
| 5,910,223 | A | 6/1999 | Tipton et al. | 148/210 |
| 6,197,126 | B1 | 3/2001 | Roland et al. | 148/262 |
| 6,217,415 | B1 | 4/2001 | Ajayi | 451/35 |

(Continued)

FOREIGN PATENT DOCUMENTS

EP 0414441 A2 2/1991

(Continued)

OTHER PUBLICATIONS

PCT International Search Report and Written Opinion mailed Oct. 31, 2007, for PCT Application Serial No. PCT/US2006/012919, filed Apr. 6, 2006.

(Continued)

*Primary Examiner*—Roy King
*Assistant Examiner*—Lois Zheng
(74) *Attorney, Agent, or Firm*—Howrey LLP

(57) ABSTRACT

A method for superfinishing a high density carbide steel component using chemically accelerated finishing is provided. The high density carbide steel component is vibrated in a vessel containing a plurality of media, with active chemistry being added to the vessel at a low flow rate. An active chemistry composition is also provided, consisting of one or more conversion coating agents having preferably a phosphate radical, and one or more chelating agents preferably including citric acid.

15 Claims, 5 Drawing Sheets

U.S. PATENT DOCUMENTS

| | | | | |
|---|---|---|---|---|
| 6,656,293 | B2 | 12/2003 | Black et al. | 148/219 |
| 2002/0088773 | A1 | 7/2002 | Holland et al. | 216/88 |
| 2005/0014597 | A1 * | 1/2005 | Michaud et al. | 475/344 |

FOREIGN PATENT DOCUMENTS

| | | | |
|---|---|---|---|
| EP | 1167825 | A2 | 1/2002 |
| EP | 1350601 | A1 | 10/2003 |
| WO | WO 98/20186 | | 5/1998 |

OTHER PUBLICATIONS

Aerospace/Airline Plating and Metal Finishing Forum, Annual Forum and Exposition, Mar. 27-29, 2001; pp. 1-140.

Arvin, et al. "The Effect of Chemically Accelerated Vibratory Finishing on Gear Metrology", American Gear Manufacturers Association, Technical Paper, Oct. 2002, pp. 1-16.

Houser, et al "Vibro-Acoustic Effects of Friction in Gears: An Experimental Investigation", Society of Automotive Engineers, Inc., 2001.

Michaud, et al "Chemically Accelerated Vibratory Finishing for the Elimination of Wear and Pitting of Alloy Steel Gears", American Gear Manufacturers Association, Technical Paper, Oct. 2001, pp. 1-14.

Nebiolo, William P., "Horsepower Retention by ISF (Isotropic Superfinishing) of Automotive Racing Components", REM Technologies, 04msec 79, pp. 1-12, Nov. 2004.

Winkelmann, et al "Effect of Superfinishing on Scuffing Resistance" ASME, Sep. 2003, DETC2003-48124, pp. 1-6.

Winkelmann, et al "Impact of Isotropic Superfinishing on Contact and Bending Fatigue of Carburized Steel" Society of Automotive Engineers, SAE International, Mar. 2002, 2002-01-1391, pp. 1-13.

Winkelmann, et al "Superfinishing Motor Vehicle Ring and Pinion Gears" American Gear Manufacturers Association Technical Paper, Oct. 2004, 04FTM13, pp. 1-14.

Zhou, et al "A New Rolling Contact Surface and "No Run-In" Performance Bearings", Journal of Tribology, Dec. 1994, 94-Trib-28, pp. 1-5.

* cited by examiner

| | | |
|---|---|---|
| LT | 1.50 | MM |
| LC GS | 0.25 | MM |
| RA | 1.50 | YM |
| RQ | 1.79 | YM |
| RZ | 6.96 | YM |
| RMAX | 8.31 | YM |
| RP | 3.18 | YM |
| RT | 8.31 | YM |

R PROFILE
LC GS 0.25 MM
VER 10.8 YM

| | | |
|---|---|---|
| LT | 1.50 | MM |
| LC GS | 0.25 | MM |
| RA | 0.16 | YM |
| RQ | 0.26 | YM |
| RZ | 1.47 | YM |
| RMAX | 1.88 | YM |
| RP | 0.40 | YM |
| RT | 1.98 | YM |

R PROFILE
LC GS 0.25 MM
VER 10.0 YM

SUPERFINISHING OF HIGH DENSITY CARBIDES

PRIORITY CLAIM

This application claims priority to U.S. Provisional Patent Application Ser. No. 60/668,901, filed Apr. 6, 2005, which is incorporated herein by reference in its entirety.

BACKGROUND OF THE INVENTION

The present invention relates generally to the superfinishing of components manufactured from alloys containing high density carbides.

Contacting components of working machines are made from steel alloys and operate under loading. Eventually the contacting components experience wear and/or fatigue leading ultimately to equipment failure. Examples of contacting components are gears, crankshaft, camshafts, tappets, lifters, bearing rollers, races or cages, or similar components. It is often desired to harden the contact surface of such components to the highest hardness possible in order to reduce wear and to increase equipment life. Examples of contact surface hardening techniques are heat treatments, ion implantation treatments, and additive engineered coating treatments such as diamond like carbon. Contact surface hardening is especially desired for equipment operating under very high loading such as large power train systems including off-highway equipment such as bull dozers, dump trucks and mining equipment, marine systems such as tug boats and ferries, and power generation systems such as gas turbine generators and wind turbine generators. Although extensive effort has been carried out over the years by large power train system manufacturers to increase the contact surface hardness of working components, smaller power train system manufacturers, such as commercial automobile manufacturers, have also shown equal interest in achieving higher hardness contact surface working components.

Similarly, extensive efforts has been carried out over the years by other industries to increase the surface hardness of metal alloys for use in other working components that require high surface durability on their contact surfaces, such as for biomedical implants, cutting tools, punches, dies, extrusion tools, expansion tools and the like.

Numerous alloys and heat treatment methods have been developed, evaluated and selected to achieve this goal. For example, U.S. Pat. No. 4,921,025, "Carburized Low Silicon Steel Article and Process," teaches a process for forming carburized steel articles containing not more than 1.1% chromium to form an austenitic surface matrix having a high density of carbides dispersed therein. After quenching, the carburized steel article is characterized by an outer surface having a high ratio of carbides and is substantially free of intergranular oxides. Components such as gears, shafts, bearings and couplings made from such carburizing treatment are greatly enhanced with regards to bending fatigue strength, wear properties, and contact fatigue strength. U.S. Pat. No. 5,910,223, "Steel Article Having High Hardness and Improved Toughness and Process for Forming the Article," teaches a process for producing articles from alloys such as SAE 4122 having a surface of high density carbides of approximately 20% of the quantifiable area.

High hardness components generally require the highest quality of contact surface finishes in order to achieve their operational performance potential. Typically, the component manufacturer will require high quality contact surface finishes of $R_a$ less than 0.25 micron or better, which are considered superfinishes. For high hardness contact surfaces, conventional grinding, honing, lapping or other surface finishing techniques becomes more and more difficult. Tool wear, for example, is accelerated as the hardness of a component is increased. Grinding, honing, lapping and the like must also be done with increasingly greater care as hardness increases in order to prevent "grind burn". Grind burn is harmful since it softens the contact surface resulting in premature wear and component failure. Furthermore, the high hardness of these components, coupled with the difficulties associated with conventional grinding, honing, lapping and the like, make it difficult to maintain the dimensional geometry of the components. Thus, high hardness components finished by conventional grinding, honing, lapping and the like must often undergo a 100% final inspection to ensure component integrity.

Even if extremely hard contact surfaces can be superfinished via grinding, honing, lapping and the like, peak to valley asperities still remain on the contact surface and cause performance problems. These residual asperities are monotropic in orientation which are not ideal for lubrication. Also, under high loading, even small peaks to valleys penetrate the lubricating film resulting in metal-to-metal contact. It is well known in the art that metal-to-metal contact between contacting components where one or both of the contact surfaces have a high hardness is more damaging than for components having lower hardnesses. This is true because components having lower hardnesses will rapidly wear off the peak to valley asperities leaving a relatively smooth contact surface with the asperities leveled. In fact, this peak to valley asperity leveling is often done under light loading during a "break-in" or "run-in" cycle prior to subjecting the equipment to full loading. By contrast, where one or both contact surfaces are made from high density carbide material, the peak to valley asperities will be fractured from the contact surface as metal-to-metal contact occurs under high loading. Such an occurrence will produce wear, stress risers and distressed metal that are initiation sites for future fatigue failure. Additionally, where one of the mating contact surfaces is made of high density carbide material. The peak to valley asperities from the high density carbide contact surface will micro-cut or micro-plow the softer mating contact surface, thereby resulting in accelerated wear, production of stress risers, and loss of contact surface geometry.

Concomitant with wear is the generation of metal debris. Metal debris from high density carbide hardened contact surfaces is more damaging than debris from softer contact surfaces. Metal debris not only damages the components from which they are generated, but also other critical components such as bearings even when lubricant filtration systems are in place. The above discussion is emphasized in U.S. Pat. No. 6,217,415 B1, "Method and Arrangement for Reducing Friction Between Metallic Components," which discusses how the rate of scuffing, wear, or pitting on the contact surface is the result of friction between the contact surface of the work machine component and a contacting surface of another work machine component. The inventor further discusses that mechanical polishing has been utilized to decrease friction between the contacting surfaces of work machine components, however, it is stressed that even after extensive mechanical polishing, microscopic contact surface irregularities (i.e., asperities) will still be present on the contacting surfaces of the work machine components. Therefore, even after mechanical polishing, there is a significant amount of friction between the contacting surfaces of work machine components due to the remaining asperities.

To eliminate the problems associated with conventional mechanical machining to reduce the contact surface roughness of high hardness contacting components, chemically accelerated vibratory finishing has been tested and evaluated. One benefit of chemically accelerated vibratory finishing over conventional machining is that it levels the peak to valley asperities. U.S. Pat. No. 4,491,500, "Method for Refinement of Metal", and U.S. Pat. No. 4,418,333, "Metal Surface Refinement Using Dense Alumina-Based Media," both of which are incorporated by reference in their entireties herein, teach the use of chemically accelerated vibratory finishing to superfinish hardened metal workpieces. The equipment can consist of a finishing barrel, vibratory bowl or a vibratory tub, centrifugal disc machine, drag finishing machine, plunge finishing machine or spindle finishing machine and the like. U.S. Pat. No. 6,656,293 B2, "Surface Treatment for Ferrous Components," teaches the advantage of isotropic finishing nitrided or nitrocarburized metal to a surface roughness with an $R_a$ less than 0.05 μm using chemically accelerated vibratory finishing. U.S. Pat. No. 5,503,481, "Bearing Steels with Isotropic Finishes," applies the teaching of U.S. Pat. No. 4,491,500 and U.S. Pat. No. 4,418,333 to superfinish hardened steel bearings.

Prior to the present invention, attempts were made to superfinish these hard contact surfaces using chemically accelerated vibratory finishing. FIG. 1 is a diagrammatic cross-section through a machined surface layer 2 containing high density carbides 1 below which is the basis metal 4. As previously discussed, chemically accelerated vibratory finishing typically levels the peak 3 to valley 9 asperities that were produced in the mechanical machining process leaving a relatively flat surface. However, prior attempts at chemically accelerated vibratory finishing produced an undesirable contact surface 2 as shown in FIG. 2. FIG. 2 illustrates one possible outcome of an attempt using chemically accelerated vibratory finishing on contact surface 2 containing high density carbides, where the carbide particles 5 protrude from the contact surface 2. This is a highly undesirable contact surface since the carbide particles 5 can penetrate the lubricating film similarly to peak to valley asperities, thereby resulting in premature wear. Another serious problem with such a contact surface is that the carbide particles 5 can easily be dislodged from the contact surface resulting in highly damaging metal debris. FIG. 3 illustrates another undesirable outcome using chemically accelerated vibratory finishing. FIG. 3 illustrates that although the high density carbide particles 6 might be partially leveled, the metal surrounding the carbides has dissolved away leaving a weakened contact surface structure 7, which will fail under high loading and quickly disintegrate leading to high wear and metal debris.

It is desirable to harden the contact surface of contacting components to as high a hardness as possible in order to reduce wear and increase equipment life. Components manufactured from alloys such as SAE 4122 having a contact surface of high density carbides of approximately 20% of the quantifiable area have these desired high hardness properties. As discussed above, conventional machining is impractical and still leaves peak to valley asperities that have a negative impact under loading. Attempts at using chemically accelerated vibratory finishing based on the prior art have failed, and created contact surfaces with highly undesirable properties—either carbide particles protrude from the contact surface, or the metal supporting the carbides is dissolved away leaving a weakened contact surface structure. What is needed is a commercially practical and successful method for superfinishing components having a contact surface layer containing high density carbides.

SUMMARY OF THE INVENTION

A method for superfinishing a high density carbide steel component using chemically accelerated finishing is provided. The high density carbide steel component is vibrated in a vessel containing a plurality of media, with active chemistry being added to the vessel at a low flow rate.

An active chemistry aqueous composition is also provided, consisting primarily of one or more conversion coating agents having radicals selected from the group consisting of phosphates, oxalates, sulfamates, and mixtures thereof, and one or more chelating agents selected from the group consisting of citric acid and its salts, ethylene diamine tetraacetic acid (EDTA) and its salts, nitrilotriacetic acid (NTA) and its salts, gluconic acid and its salts, and mixtures thereof. The weight ratio of chelating agents to conversion coating ingredients is about 1:1 to about 2:1, and preferably about 1.3:1 to about 1.7:1. The pH of the aqueous composition is in the range of about 4.5 to about 6.8, and preferably between about 5.0 to about 5.5. The combined concentration of conversion coating agents and chelating agents is less than about 1.5 w/w %, and preferably less than about 1.25 w/w %.

BRIEF DESCRIPTION OF THE DRAWINGS

A more complete understanding of the present invention may be obtained with reference to the accompanying drawings.

DETAILED DESCRIPTION OF PRESENT INVENTION

Figure 1:
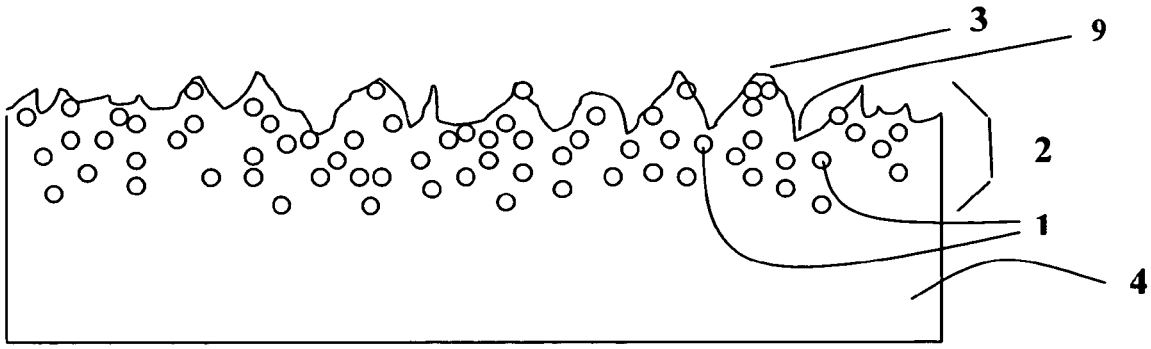
FIG. 1 is a diagrammatic cross-section through a machined surface layer containing high density carbides.

What is disclosed herein is a commercially practical method for superfinishing high density steel carbides utilizing a novel active chemistry composition.

The following terminology is used to describe the preferred embodiment and examples of the present invention, and to aid one of ordinary skill in the art in executing the methods described herein 1. Roughness Average ($R_a$): The most commonly used parameter to measure the roughness of a contact surface. It is the average deviation of the surface profile to the mean line over the length of assessment.
2. Superfinish: To lower the Roughness Average of a surface to an $R_a$ of less than 0.25 micron.
3. Carbide Particles: Very hard particles formed from carbon and another element that, when dispersed in a case carburized surface, drastically increase its hardness.
4. Wear: The loss of metal from contacting surfaces during operation.

5. Metal Debris: Metal particles that break free from the contact surface of the contacting components.
6. Etched Surface: Non-uniform attack of a surface by an acid resulting in a roughened surface having a dull appearance.
7. Dissolution: Metal surface around carbides is dissolved by acid solution.
8. Media: Ceramic, plastic, or metal elements in the vibratory equipment that contact the component surface to be surface finished. In the context of superfinishing using active chemistry, media wears off the soft conversion coating formed by the active chemistry.
9. Active Chemistry: As used in the prior art, a chemistry used in chemically accelerated vibratory finishing that reacts with the surface of the metal and creates a visible, stable, soft conversion coating. As used in the present invention, the active chemistry reacts with the surface of the metal, however, it is not known if the chemistry used is creating a conversion coating.
10. Burnish Chemistry: A cleaner that does not react with the contact surface of the metal, but helps remove the conversion coating from the contact surface of the metal
11. Flow-Through Process: Active chemistry is continually delivered into the vibratory equipment and continually drained out of the bottom so that the process can be run for many hours without flooding of the machine.
12. Isotropic Superfinish: A surface finish which has an $R_a$ less than 0.1 micron and a non-direction surface texture/pattern imparted by chemically accelerated vibratory finishing.

According to a preferred embodiment of the present invention, chemically accelerated vibratory finishing is carried out in vibratory finishing bowls or tubs for superfinishing metal components such as steel high density carbide components. Approximately 80% of the vibratory equipment volume is filled with plastic, ceramic or metal media. Approximately 20% or less of the vibratory equipment volume is filled with components to be superfinished. Examples of high density carbide components that would benefit from superfinished surfaces include gears, crankshaft, camshafts, tappets, lifters, bearing rollers, races or cages, and other high density components that require high surface durability on their contact surfaces, such as biomedical implants, cutting tools, punches, dies, extrusion tools, expansion tools and the like.

The following examples are included to demonstrate the novel methods and compositions of the present invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the scope of the invention.

Example 1

Four SAE 4122 steel, high density carbide spur gears were finished as described in the table below using prior art compositions and techniques:

| Parameter | Specification | Notes |
|---|---|---|
| Machine Type: | 10-ft$^3$ Sweco vibratory bowl | |
| Amplitude (mm): | 5.0 | |
| Lead Angle: | 60° | |
| Starting Surface Roughness | 1.0 $R_a$ | μm |
| Final Surface Roughness | 1.5 $R_a$ | μm |
| Media: | FERROMIL ® Media # 9 | mixed sizes: 9/16" × 1/4" × 7/8" ellipses, 1 1/8" × 3/8" AT 25 angle cut triangles, 1/2" × 1/2" AT45 angle cut triangles |
| Active Chemistry: | FERROMIL ® FML-53 | commercially available from REM Chemicals, Inc. |
| Concentration: | 10.0% by volume | |
| Flow Rate: | 2.46 liter/hour | 0.25 liter/hour/1.0 ft$^3$ of bowl volume |
| Processing Time (hours) | 2.0 | |
| Burnish Chemistry: | FERROMIL ® FBC-50 | commercially available from REM Chemicals, Inc. |
| Concentration: | 1.0% by volume | |
| Flow Rate: | 90 liter/hour | |
| Processing Time (hours) | 1.0 hour | |

In this example, commercially available liquid products for chemically accelerated vibratory finishing (i.e. FERROMIL® FML-53 REM Chemicals, Inc.) is diluted 10 percent by volume in a flow through process, although it is believed that 5 to 20 percent by volume dilution could have been used for this application. The active chemistry was continually delivered to the vibratory equipment at a flow rate of approximately 0.25 liters per hour per cubic foot of vibratory equipment volume, which is much slower than the 0.95 liters per hour per cubic foot of vibratory equipment volume taught by the prior art.

Figure 2:
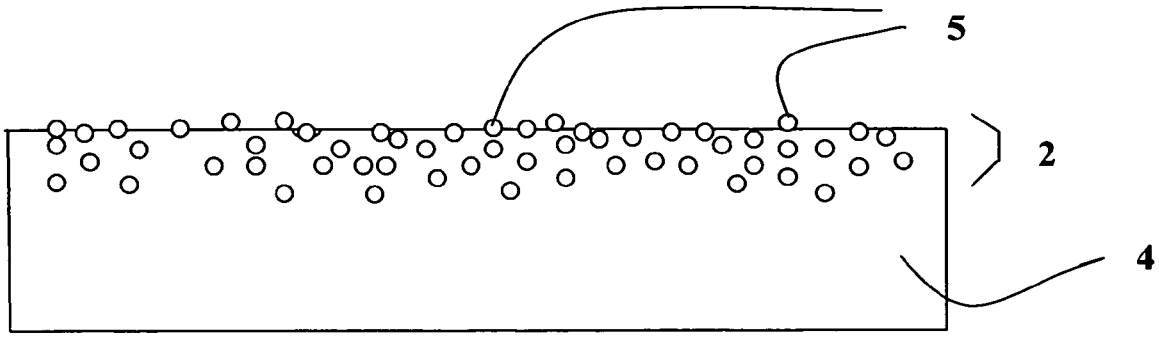
FIG. 2 is a diagrammatic cross-section of a hardened surface layer illustrating high density carbides protruding from the surface.
Figure 3:
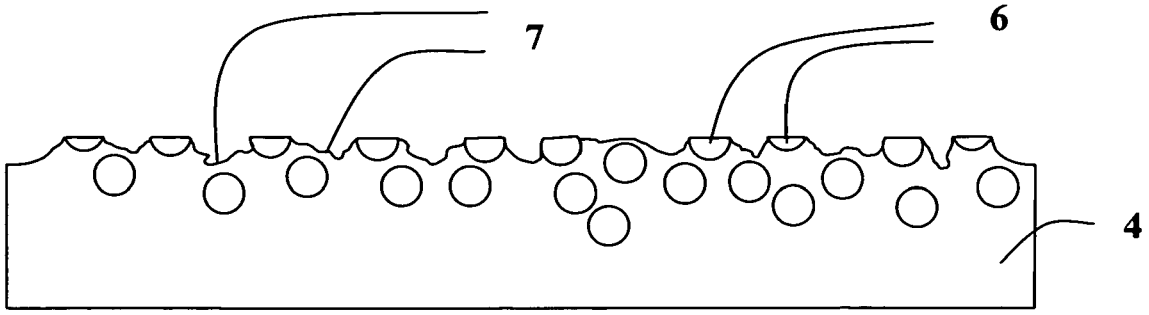
FIG. 3 is a diagrammatic cross-section of a hardened surface layer illustrating etching and/or dissolution surrounding the high density carbides.
Figure 5:
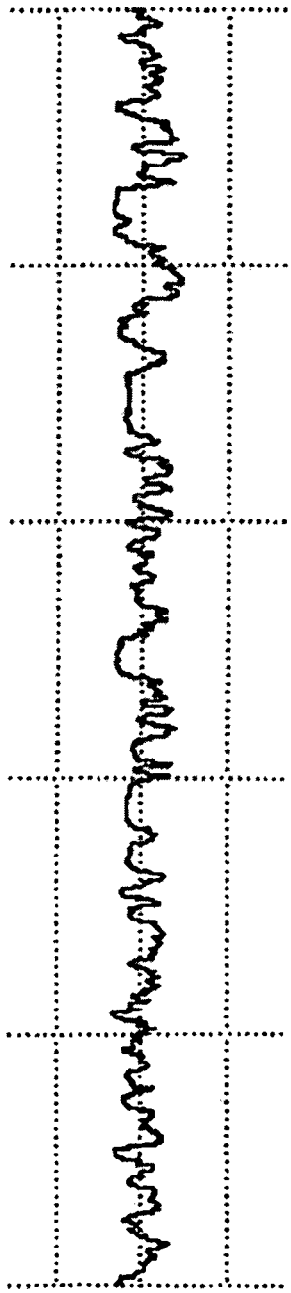
FIG. 5 is a surface roughness analysis of a high density carbide steel component (SAE 4122) finished using prior art techniques.

When introduced into the vibratory bowl, the active chemistry produced a visible, stable, soft conversion coating on the surface of the gears. The conversion coating was black in color and was readily rubbed from the surface by the media. The visible black color of the conversion coating was empirical evidence that the conversion coating had adequate stability and thickness to generate a superfinished surface. In this example however, the active chemistry has severely etched and/or dissolved the base metal and left the high density carbides exposed and protruding, which is an unacceptable surface as previously described in FIGS. 2 and 3. This result occurred despite the 10% dilution of active chemistry and the reduced active chemistry flow rate. FIG. 5 shows the surface roughness profilometer analysis (using a 5 micron radius stylus) for a typical surface finished as described by Example 1. It is clearly etched, with the $R_a$ increasing to a level higher than it started due to the etching.

According to the teachings of the present invention, a novel chemistry is presented that allows one to superfinish high density carbide components without the unwanted etching and dissolution of the base metal. The novel chemistry consists generally of an aqueous solution comprising (1) conversion coating ingredients with radicals including, but not limited to, phosphates, oxalates, sulfates, sulfamates and mixtures thereof; and (2) chelating agents including, but not limited to, citric acid and its salts, ethylene diamine tetraacetic acid (EDTA) and its salts, nitrilotriacetic acid (NTA) and its salts, gluconic acid and its salts, and mixtures thereof. Specifically advantageous are mixtures of conversion coating ingredients of the phosphate radical combined with chelating agents consisting of citric acid and its salts. It will be apparent to those of skill in the art that variations may be applied to the compositions described herein without departing from the concept and spirit of the present invention. More specifically, it will be apparent that certain agents which are chemically related or functionally equivalent may be substituted without undue experimentation for the agents described herein while the same or similar results will be achieved. A preferred composition of the active chemistry of the preferred invention is as follows:

| Component | Concentration w/w % | CAS # |
|---|---|---|
| Water | 99.475-98.425 | 7732-18-5 |
| Sodium acid pyrophosphate | 0.07-0.21 | 7758-16-9 |
| Monosodium phosphate | 0.12-0.36 | 7758-80-7 |
| Sodium tripolyphosphate | 0.025-0.075 | 7758-29-4 |
| Citric Acid | 0.065-0.195 | 77-92-9 |
| Trisodium citrate dihydrate | 0.24-0.72 | 6132-04-3 |
| Chemax MAXHIB PT-10T (commercial corrosion inhibitor) | 0.005-0.015 | proprietary mixture |

The weight ratio of chelating agents to conversion coating ingredients is preferably in the weight ratio ranging from about 1:1 to about 2:1, and more preferably in the weight ratio ranging from about 1.3:1 to about 1.7:1. The working pH of the solution is preferably in the range of about 4.5 to about 6.8, and more preferably in the range of about 5.0 to about 5.5. The working concentration of the aqueous solution is preferably less than about 1.5 w/w % active ingredients (conversion coating ingredients and chelating agents), and more preferably less than about 1.25 w/w % active ingredients, and is most preferably about 1.0 w/w % active ingredients. Furthermore, one of ordinary skill in the art will appreciate that in certain instances it may be advantageous to add corrosion inhibitors such as Chemax MAXHIB PT-10T and the like, as well as surface wetting agents.

The novel method consists of chemically accelerated vibratory finishing using a finishing barrel, vibratory bowl or a vibratory tub, centrifugal disc machine, drag finishing machine, plunge finishing machine or spindle finishing machine and the like, the novel chemistry listed above used on a flow-through basis. The present invention uses a flow rate of approximately 0.25 to 0.60 liters per hour per cubic foot of vibratory equipment volume, which is greatly reduced compared to prior art applications.

Figure 4:
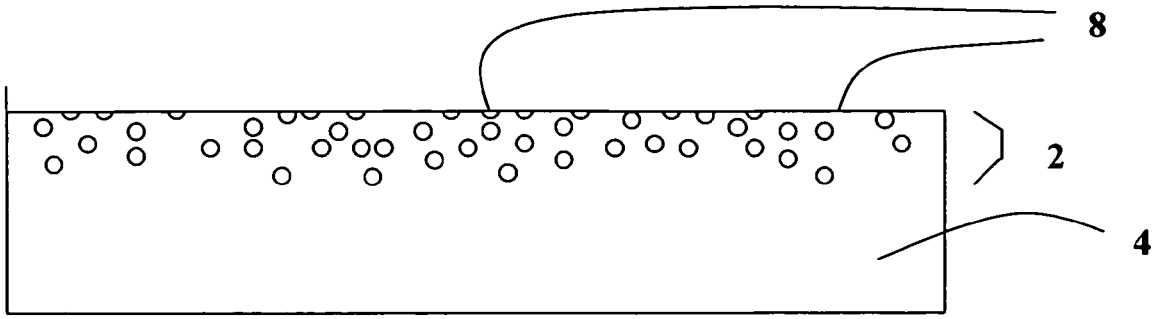
FIG. 4 is a diagrammatic cross-section of a component containing high density carbides after superfinishing using the present invention.

When introduced into the vibratory equipment according to the method of the present invention, this novel chemistry does not produce a visible, stable, soft conversion coating on the surface of the high density carbide components being processed, as occurs with prior art superfinishing applications using active chemistry. The conversion coating produced on high density carbide steel components is at most light grey in color or may appear only as a slightly mottled or hazy surface, and is typically only perceptible by rubbing a white paper towel across the surface. The rubbing motion across the high density carbide component created by the vibratory equipment and media effectively levels the peak to valley asperities. The media used can be any abrasive or non-abrasive media known to one of ordinary skill in the art, such as plastic, ceramic or metal. This process is continued in the vibratory equipment until the peak to valley asperities are leveled to the preferred degree. During this process, the high density carbides are also leveled along with the peak to valley asperities. FIG. 4 is a diagrammatic cross-section of a component containing high density carbides after superfinishing using the teachings of the present invention. The active chemistry is then rinsed from the machine with a neutral soap to produce a bright and reflective surface finish.

Example 2

Three SAE 4122 steel, high density carbide spur gears, approximately 12.25 centimeters×13 centimeters, were superfinished in accordance with the teachings of the present invention as described in the table below:

| Parameter | Specification | Notes |
|---|---|---|
| Machine Type: | 600 liter Vibrachimica vibratory bowl | |
| Amplitude (mm): | 4.0 | |
| Lead Angle: | 60° | |
| Starting Surface Roughness | 1.0 $R_a$ | μm |
| Final Surface Roughness | 0.16 $R_a$ | μm |
| Media: | FERROMIL ® Media # 9 | ⅜ inch cylinder wedges (Tricycle) |
| Active Chemistry: | Novel Chemistry<br>Water-98.95 w %<br>Sodium acid pyrophosphate-0.14 w %<br>Monosodium phosphate-0.24 w %<br>Sodium tripolyphosphate-0.05 w %<br>Citric acid-0.13 w/w %<br>Trisodium citrate dehydrate-0.48 w %<br>Chemax MAXHIB PT-10T-0.01 w % | |

-continued

| Parameter | Specification | Notes |
|---|---|---|
| Concentration: | Neat, 100% | |
| Flow Rate: | 5.9 liter/hour | 0.28 liter/hour/1.0 $ft^3$ of bowl volume |
| Processing Time (hours) | 6.0 | |
| Burnish Chemistry: | FERROMIL ® FBC-50 | commercially available from REM Chemicals, Inc. |
| Concentration: | 1.0% by volume | |
| Flow Rate: | 180 liter/hour | |
| Processing Time (hours) | 1.0 hour | |

Figure 6:
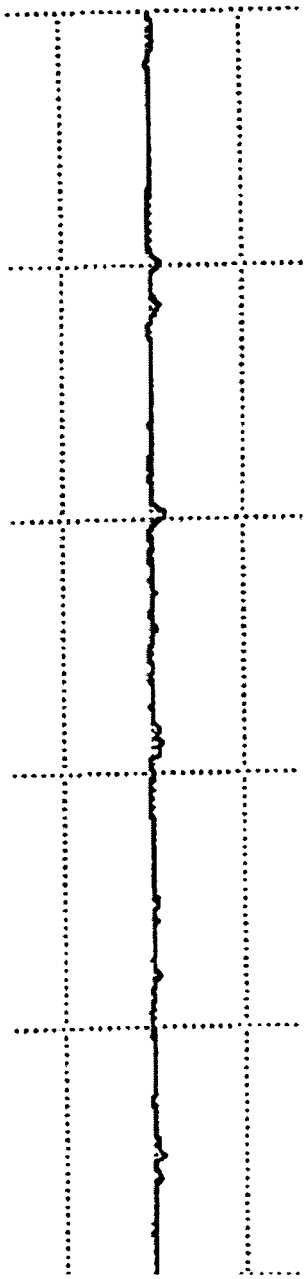
FIG. 6 is a surface roughness analysis for a high density carbide steel component (SAE 4122) superfinished according to certain teachings of the present invention.

The visible appearance of the superfinished gear in Example 2 is bright, reflective and smooth with the majority of the machining lines removed. There is no indication of etching, dissolution or carbide protrusions under 10× magnification. FIG. 6 shows the surface roughness profilometer analysis (using a 5 micron radius stylus) after superfinishing and lists the parameters used during the analysis. Although the final surface of the gears of Example 2 are superfinished to 0.16 micron surface roughness ($R_a$), other testing has demonstrated that the teachings of the present invention can achieve an isotropic superfinish quality, that is less than 0.1 micron surface roughness ($R_a$) for high density carbide steels.

Prior to the present invention, attempts to superfinish components having a contact surface layer containing high density carbides were unsuccessful. Accordingly, several objects and advantages of the present invention may be realized:

1. Components manufactured from SAE 4122 or similar alloys, which contains high density carbides in excess of 20% of quantifiable contact surface area, can be superfinished.
2. Chemically accelerated vibratory finishing, which has previously been unsuccessful for such applications, is employed.
3. The contact surface can be smoothed to less than 0.25 micron roughness average ($R_a$), and if desired, less than 0.10 micron ($R_a$).
4. Peak to valley asperities created by mechanical machining processes are leveled.
5. An isotropic superfinish is created by leveling the contact surface to the point where all peak to valley asperities are removed.
6. The resultant contact surface is free of deleterious carbide protrusions.
7. The resultant contact surface is free of etching and/or dissolution.
8. The resultant contact surface is not structurally weakened by etching and/or dissolution of the metal surrounding the high density carbides.
9. Damaging metal debris is significantly reduced or eliminated during equipment operation since the peak to valley asperities have been leveled or removed.
10. The resultant superfinished contact surface imparts performance benefits to the working components with regards to scuffing, contact fatigue, bending fatigue, operating temperature, wear, friction and noise/vibration.
11. The resultant superfinished component when mated to another superfinished component does not produce micro-cutting or micro-plowing because peak to valley asperities produced by machining/grinding have been leveled or removed.
12. Even if the contact surfaces of the contacting components are not superfinished to the process's lowest achievable roughness average ($R_a$), many performance benefits are still realized since the peak to valley asperities have been leveled. This has several benefits. First, a significant increase in contact surface carrying capacity is achieved. Second, the smoothed contact surface facilitates hydrodynamic lubrication. Third, it significantly reduces the potential for wear.
13. The present invention also provides a practical method for superfinishing components having a proprietary alloy and heat treatment containing high density carbides, high density nitrides or a mixture of high density nitrides and carbides.
14. The present invention also provides a practical method for superfinishing components manufactured from high density carbide containing alloys such as, but not limited to, bio-medical implants, cutting tools, punches, dies, extrusion tools, expansion tools and the like.

Further objects and advantages of this invention will become apparent to one of ordinary skill in the art from a consideration of the present disclosure.

The novel compositions and methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the methods described herein without departing from the concept, spirit and scope of the invention. More specifically, it will be apparent that certain agents which are chemically related may be substituted for the agents described herein while the same or similar results would be achieved. All such similar substitutes and modifications apparent to those skilled in the art are deemed to be within the scope and concept of the invention.

What is claimed is:

1. A method for the refinement of high density carbide steel component, comprising:

(a) providing an aqueous solution comprising:

a first mixture of sodium acid pyrophosphate, monosodium phosphate, and sodium tripolyphosphate, wherein the concentration of the first mixture in the aqueous solution is from about 0.22 to about 0.65 weight %, and a second mixture of citric acid and trisodium citrate dihydrate, wherein the concentration of the second mixture in the aqueous solution is from about 0.31 to about 0.92 weight %, wherein the pH of the aqueous solution is from about 4.5 to about 6.8 at substantially ambient temperature;

(b) placing a high density carbide steel component into a vessel containing a plurality of media, wherein carbide is present in the component in excess of about 20% of the quantifiable surface area;

(c) introducing the aqueous solution to the vessel at a flow rate of about 0.25 to about 0.60 liters per hour per cubic foot of vessel volume;

(d) agitating the component and the plurality of media in the vessel while maintaining the surfaces of the component in a wetted condition with said aqueous solution to produce a stable, physically removable coating on the surfaces of the component, wherein the agitating provides relative movement and contact between the component and the media; and (e) continuing the agitating step for a period sufficient to create a finished surface having a desired surface roughness.

2. The method of claim 1, wherein the high density carbide steel component is SAE 4122.

3. The method of claim 1, wherein the aqueous solution further comprises a corrosion inhibitor at a concentration greater than 0.005 weight %.

4. The method of claim 1, wherein the pH of the aqueous solution is from about 5.0 to about 5.5.

5. The method of claim 1, wherein the media is selected from the group consisting of ceramic media, plastic media, metal media, and mixtures thereof.

6. The method of claim 1, wherein the finished surface displays no etch.

7. The method of claim 1, wherein the finished surface is not structurally weakened.

8. The method of claim 1, wherein the finished surface has a surface of roughness of less than about 0.25 micron Ra.

9. The method of claim 1, wherein the finished surface has a surface of roughness of less than about 0.10 micron Ra.

10. The method of claim 1, wherein carbide does not substantially protrude from the finished surface.

11. The method of claim 1, wherein the sodium acid pyrophosphate concentration in the aqueous solution is from about 0.07 to about 0.21 weight %.

12. The method of claim 1, wherein the monosodium phosphate concentration in the aqueous solution is from about 0.12 to about 0.36 weight %.

13. The method of claim 1, wherein the sodium tripolyphosphate concentration in the aqueous solution is from about 0.025 to about 0.075 weight %.

14. The method of claim 1, wherein the citric acid concentration in the aqueous solution is from about 0.065 to about 0.195 weight %.

15. The method of claim 1, wherein the trisodium citrate dihydrate concentration in the aqueous solution is from about 0.24 to about 0.72 weight %.

* * * * *

UNITED STATES PATENT AND TRADEMARK OFFICE

CERTIFICATE OF CORRECTION

PATENT NO. : 7,641,744 B2
APPLICATION NO. : 11/400835
DATED : January 5, 2010
INVENTOR(S) : Lane W. Winkelmann It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 615 days.

Signed and Sealed this

Sixteenth Day of November, 2010

David J. Kappos

David J. Kappos
*Director of the United States Patent and Trademark Office*